US005908131A

United States Patent [19]

Yamaguchi

[11] Patent Number: 5,908,131

[45] Date of Patent: Jun. 1, 1999

[54] COVER LOCKING DEVICE WITH INDEPENDENTLY OPERABLE UNLOCKING MECHANISMS

[75] Inventor: Takuji Yamaguchi, Wakayama, Japan

[73] Assignee: Noritsu Koki Co., Ltd, Wakayama, Japan

[21] Appl. No.: 08/740,001

[22] Filed: Oct. 23, 1996

[30] Foreign Application Priority Data

Oct. 24, 1995 [JP] Japan ..... 7-275635

[51] Int. Cl.[6] ..... B65D 45/16

[52] U.S. Cl. ..... 220/324; 220/315; 292/341.17; 396/513; 396/518

[58] Field of Search ..... 312/292; 292/341.17, 292/202, DIG. 11; 220/324, 315, 200; 396/589, 594, 513, 518, 536, 595–601, 636, 637; 70/159–162, DIG. 63, 443

[56] References Cited

U.S. PATENT DOCUMENTS

| | | | |
|---|---|---|---|
| 2,115,253 | 4/1938 | Christoffersen | 70/162 |
| 2,281,577 | 5/1942 | Haynes | 70/159 |
| 2,741,505 | 4/1956 | Courney | 292/341.17 |
| 3,459,323 | 8/1969 | Boothman | 220/324 |
| 3,590,614 | 7/1971 | Kunst | 70/443 X |
| 3,631,971 | 1/1972 | Rinkleilb | 220/324 X |
| 3,921,934 | 11/1975 | Dorland et al. | 242/338.1 |
| 4,411,725 | 10/1983 | Siegel et al. | 156/353 |
| 4,512,167 | 4/1985 | Remenicky | 70/443 |
| 4,645,323 | 2/1987 | Stella | 396/592 |
| 4,690,073 | 9/1987 | Shoop | 70/DIG. 63 X |
| 4,839,682 | 6/1989 | Koboshi et al. | 396/598 |
| 5,031,852 | 7/1991 | Dowling et al. . | |
| 5,235,830 | 8/1993 | Benge | 70/159 X |
| 5,257,519 | 11/1993 | Miller, III | 70/443 X |
| 5,347,334 | 9/1994 | Smart et al. . | |
| 5,526,226 | 6/1996 | Katoh et al. | 70/159 X |
| 5,668,645 | 9/1997 | Yamaji | 358/487 |
| 5,678,437 | 10/1997 | Walla | 70/370 |
| 5,685,583 | 11/1997 | Meck et al. | 292/347 |
| 5,736,305 | 4/1998 | Nomura | 430/403 |

FOREIGN PATENT DOCUMENTS 0 465 953 1/1992 European Pat. Off. .

OTHER PUBLICATIONS

Patent Abstracts of Japan, vol. 95, No. 4, May 31, 1995 & JP 07 005540 A (Minolta Camera), Jan. 10, 1995 *abstract*.

*Primary Examiner*—Stephen K. Cronin
*Assistant Examiner*—Robin A. Hylton
*Attorney, Agent, or Firm*—Wenderoth, Lind & Ponack, L.L.P.

[57] ABSTRACT

A locking device for use in a processing device for processing photosensitive material such as photographic film has a light-shield cover that can be unlocked without moving a knob plate. The knob plate has an engaging member for locking the light-shield cover. An unlocking mechanism is provided to unlock the light-shield cover without moving the knob plate. The unlocking mechanism has a pushing head, and an unlocking lever having a tip engageable with the engaging member and adapted to be pushed by the pushing head. By moving the unlocking lever with the pushing head until its tip disengages from the engaging member, the engaging member can pass through a cutout, so that the light-shield cover can be unlocked and opened.

15 Claims, 10 Drawing Sheets

COVER LOCKING DEVICE WITH INDEPENDENTLY OPERABLE UNLOCKING MECHANISMS

BACKGROUND OF THE INVENTION

This invention relates to a locking device for locking a cover of a device whose interior has to be kept blacked out, such as a film winder.

Most photographic devices for processing photosensitive material, such as a dark box for rewinding undeveloped film from one cartridge to another, are provided with a locking means for locking a cover plate of the device after the cover plate is closed on inner mechanism is activated to prevent an accident in which the cover plate opens unexpectedly so that the photographic film or paper inside is exposed to light.

A conventional such locking means is shown in FIG. 10. It comprises a locking lever 3 provided inside a case 2 having an openable cover plate 1, and a hook 1*a* fixed to the back of the cover plate 1. The locking lever 3 is pivotable about a hinge 5 and biased by a spring 4 coupled to a bracket 2× provided inside the case 2.

A solenoid 6 has a rod 6*a* coupled to the locking lever 3 to lock the cover plate 1. When the mechanism in the case 2 is activated, it produces a signal to energize the solenoid 6. When energized, the solenoid 6 moves the locking lever 3 from the position shown by chain line to the position shown by solid line, locking the cover plate 1. A reset push button 7 is provided for forcibly unlocking the cover plate 1 so that the cover plate can be opened to inspect the inside of the device even while the device is in operation.

With this conventional locking device, if the photographic device should malfunction or fail, it is possible to open the cover plate to inspect the inside of the device by pressing the reset button after confirming that the cover plate may be opened.

In the case of a locking device of the type in which a knob plate is provided on the cover plate so that the cover plate can be locked by closing it and moving the knob plate, and in which other parts of the photographic device can be operated by moving the knob plate, in order to unlock the cover plate and open it to inspect the inside of the photographic device while it is in operation, the other parts of the device linked to the knob plate will be influenced. This sometimes makes it impossible to unlock the cover plate.

It is therefore desirable that the locking device have an unlocking means which can unlock the cover plate without affecting any other parts of the photographic device.

An object of this invention is to provide a locking device for use in a photographic device provided with an openable light-shield cover adapted to be locked in position by moving a knob, the locking device being provided with an unlocking means capable of unlocking the cover without moving the knob even if the movement of the knob is operatively associated with the operation of other parts of the photographic device so that cover can be opened in an emergency by operating the unlocking means.

SUMMARY OF THE INVENTION

According to this invention, there is provided a locking device for use in a processing device for processing photographic material, the processing device having a case and a light-shield cover mounted on the case so as to be movable between an open position and a closed position. The locking device includes a knob provided on the light-shield cover and having one engaging means adapted to engage another engaging means to lock the light-shield cover in the closed position, an interlocking means or mechanism for preventing the movement of the knob with two engaging means in engagement, and an unlocking means or mechanism for disengaging the two engaging means to unlock the light-shield cover.

The locking device according to this invention is used mainly with a device for processing photosensitive material such as photographic film. Such a processing device needs a light-shield cover which can be opened and closed and a locking device for locking the light-shield cover in the closed position.

The light-shield cover is locked in position by sliding the knob plate mounted on the light-shield cover until the engaging means engages the case of the processing device. With the engaging means in engagement with the case, the knob plate is double-locked by the interlocking mechanism.

While the processing machine is in operation, the knob plate is immovably locked in position by the interlocking mechanism, so that the light-shield cover cannot be opened.

The interlocking mechanism comprises a locking member adapted to engage the knob, and an unlocking device. The light-shield cover is preferably locked in position by restricting the movement of the knob plate by bringing the locking member into engagement with a protrusion provided on the knob plate.

In a conventional arrangement, such an interlocking mechanism is provided integrally with the unlocking mechanism. But in this invention, they are provided independently of each other.

Basically, the light-shield cover cannot be opened while the processing device is in operation. But there may be an occasion when it is necessary to open the cover to inspect the inside of the processing device due, e.g., to a failure of the device such as a failure of its film feed mechanism.

In such a case, it is possible to open the light-shield cover by operating only the unlocking mechanism while not moving the knob plate and other functional members associated with the knob plate.

Specifically, the light-shield cover can be opened by pushing the unlocking means to move a locking member to the position where the engaging means can pass through a cutout formed in the case.

Needless to say, this locking device can be used not only in a film rewinder, which is an embodiment of the invention, but also with any other processing device having a light shield cover which is opened and closed by moving a knob plate which is operatively associated with another functional member.

Other features and objects of the present invention will become apparent from the following description made with reference to the accompanying drawings, in which:

DETAILED DESCRIPTION OF THE PREFERRED EMBODIMENT

Figure 1A:
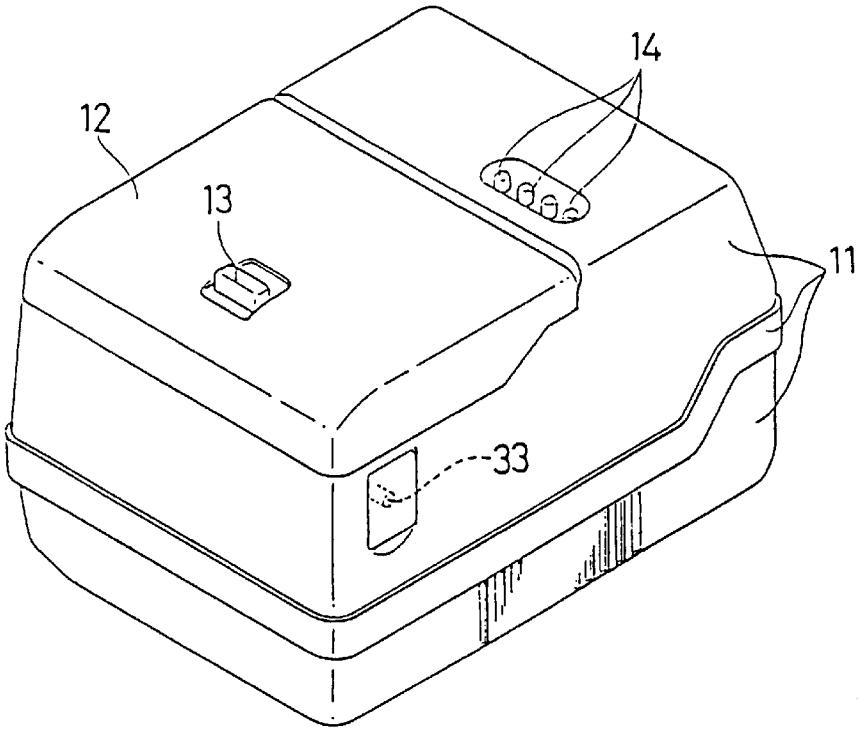
FIGS. 1A and 1B is a perspective view of a film rewinder provided with a locking device embodying the invention.
Figure 1B:
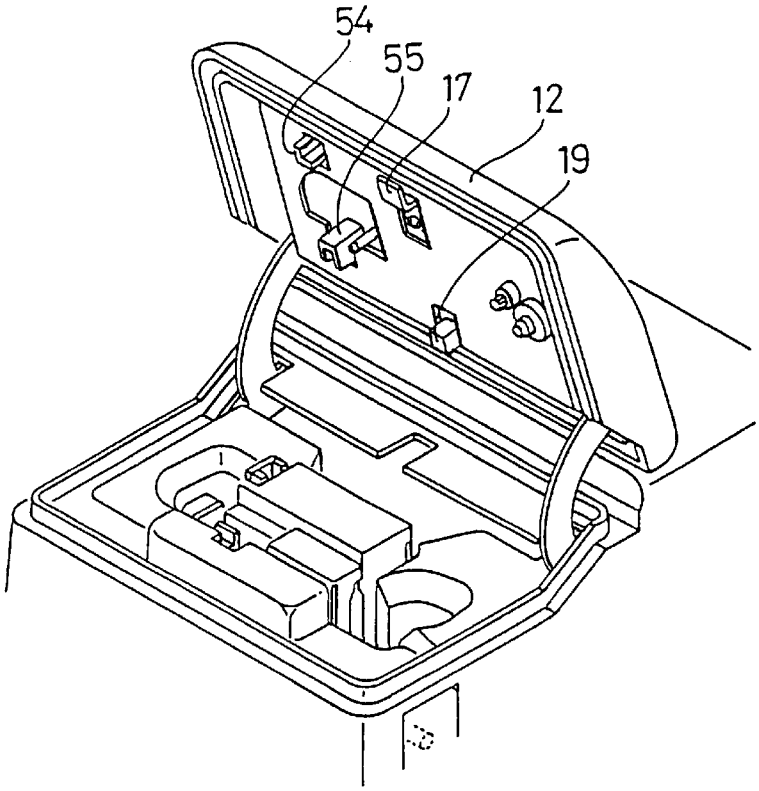

Now referring to the drawings, embodiments of this invention are described. FIG. 1A is a perspective view of a film rewinder provided with a locking device embodying this invention on a light-shield cover 12 of a case 11. The cover 12 has a knob 13. Indicator lamps 14 are provided on the case 11. The cover 12 can be opened (FIG. 1B) by pivoting it relative to the case 11.

Figure 2:
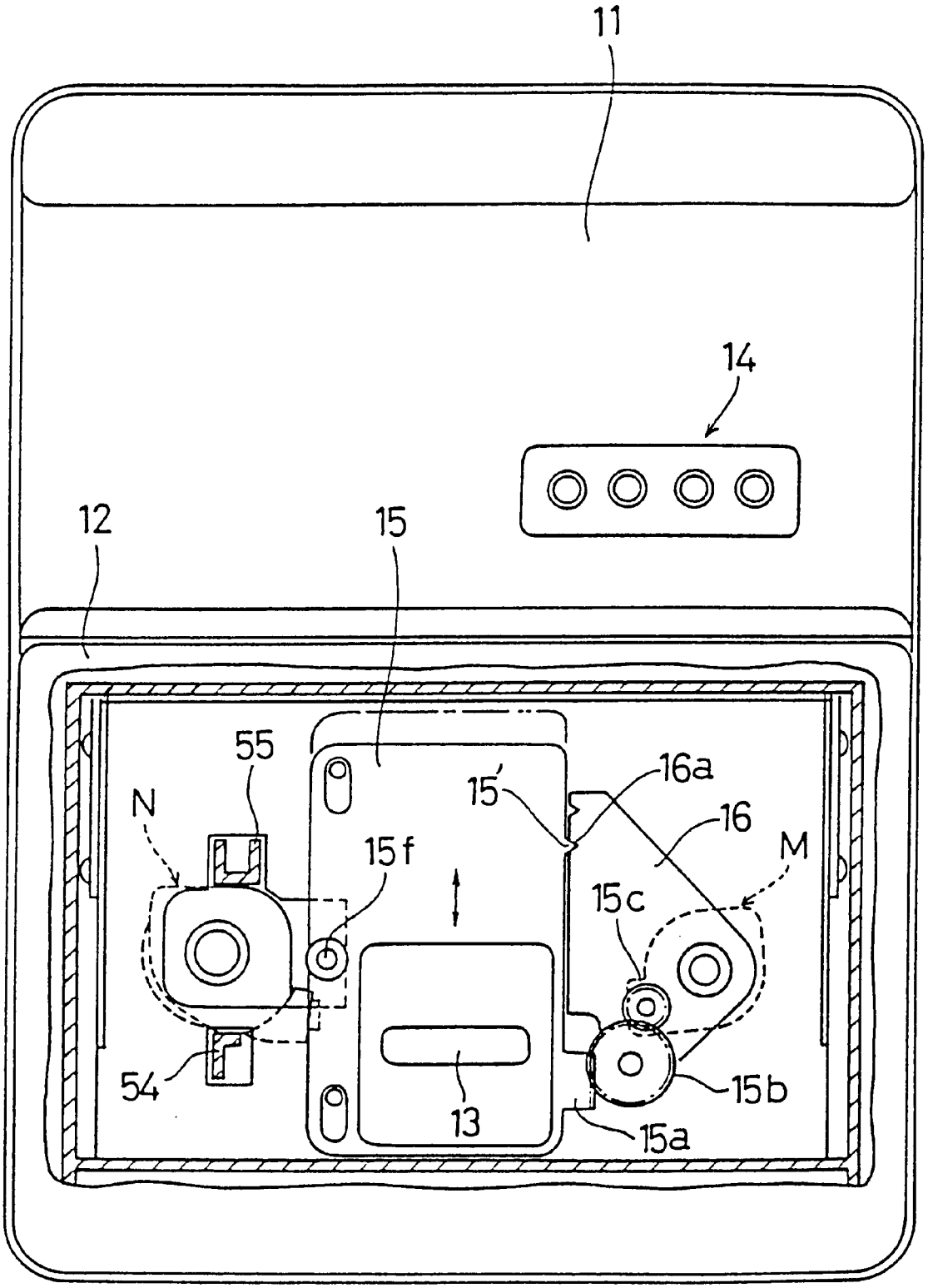
FIG. 2 is a plan view of the same with a top lid of a light-shield cover removed.

The light-shield cover 12 has a double-wall structure. A knob plate 15 shown in FIG. 2 is mounted between the double walls of the cover 12 so as to be slidable in opposite directions to spaced opposite first and second positions by movement of the knob 13. The knob 13 is integrally formed on the knob plate 15 and protrudes from the light-shield cover 12.

The knob plate 15 has a protrusion 15' adapted to engage recesses 16*a* formed in a restrictor plate 16 to restrict the movement of the knob plate 15. The movement of a plate 15 is associated with the inner mechanism of the film rewinder in the manner to be described later.

Figure 3:
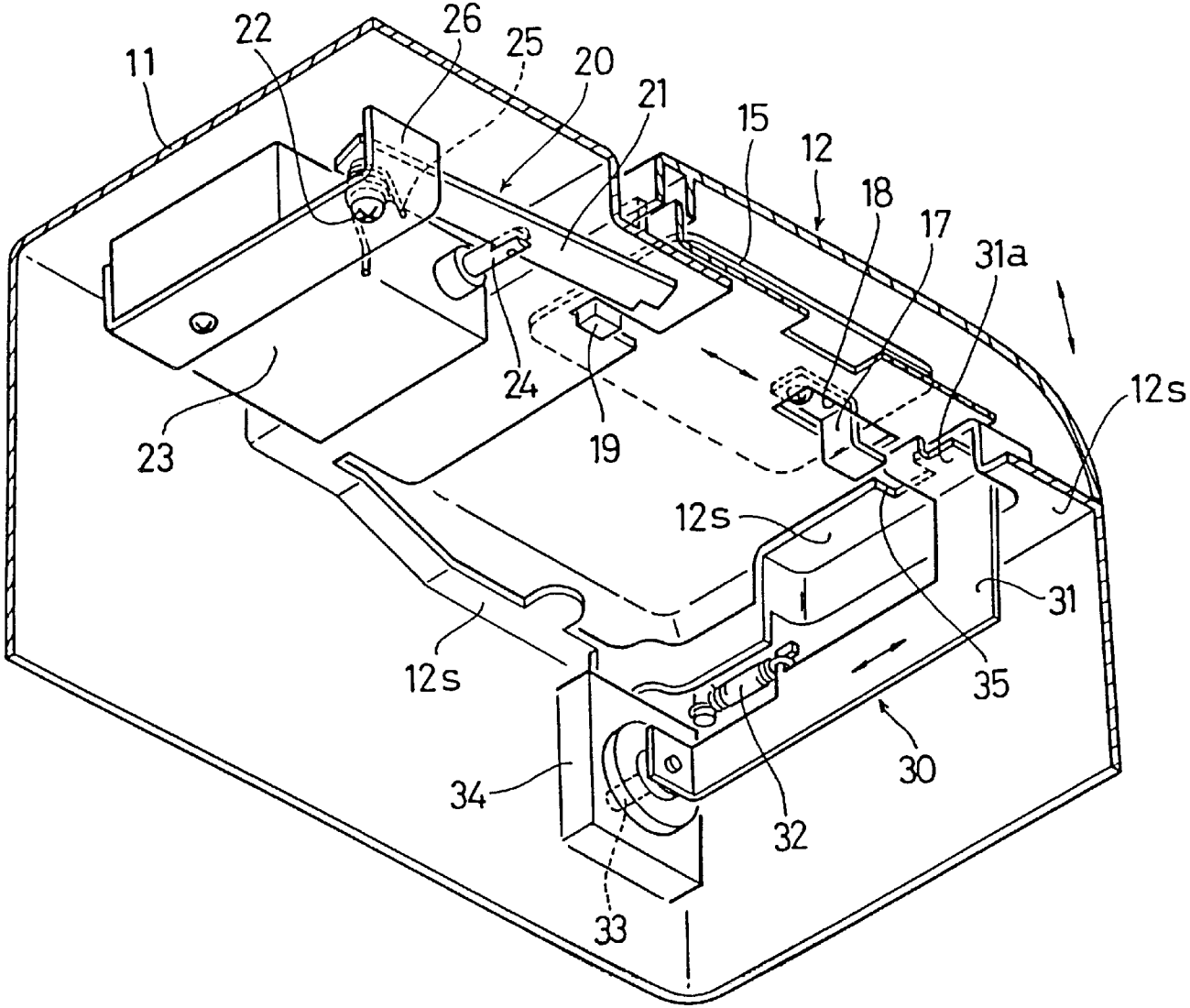
FIG. 3 is a schematic perspective view of the locking device, as viewed obliquely upwardly.

FIG. 3 is a perspective view of the film rewinder showing its interior as viewed obliquely upwardly toward the knob plate 15. In the illustrated state, the light-shield cover 12 is closed, resting on a horizontal side frame 12*s* provided inside the case 11. The knob plate 15 has a first engaging member in the form of an L-shaped hook 17 at one end thereof with respect to its moving direction shown by an arrow. The hook 17 extends through an opening 18 formed in a back plate of the light-shield cover 12.

The knob plate 15 has at its other end a protrusion 19 extending through the back plate of the light-shield cover 12 and protruding into the case. An interlocking device 20 is provided opposite to the protrusion 19 and locks the light-shield cover 12 in the closed position by restricting the movement of the protrusion 19 and thus the knob plate 15. Protrusion 19 and device 20 form one locking device or means operable to maintain knob plate 15 in a locked or first position.

The interlocking device 20 comprises a locking lever 21 having a cutout adapted to engage the protrusion 19, and a solenoid 23 for pivoting the locking lever 21 about a hinge 22. The solenoid 23 has a rod 24 in engagement with the locking lever 21. By turning on and off the solenoid 23, the locking lever 21 is moved to locking and unlocking positions.

FIG. 3 also shows an unlocking mechanism 30. It comprises an L-shaped unlocking lever 31, a spring 32 biasing the unlocking lever 31 to a normal position, and a pushing head 33 for pushing one end of the lever 31. The pushing head 33 is received in a recess 34 formed in one side wall of the case. The recess 34 is normally closed by a small lid (not shown).

The L-shaped unlocking lever 31 has an L-shaped tip 31*a* forming a second engaging member adapted to engage and lock the hook 17 when the knob plate 15 is moved forwardly to the first position thereof until the hook 17 overlaps the L-shaped tip 31*a*. In order to unlock the light-shield cover 12, the unlocking lever 31 is pushed until its tip 31*a* completely separates from the hook 17. In this state, the hook 17 faces a recess 35 formed in the side frame 12*s*. The recess 35 is slightly larger than the hook 17, so that the hook can be without obstruction, and cover 12 is thus unlocked even with plate 15 locked in the first position thereof.

Figure 6:
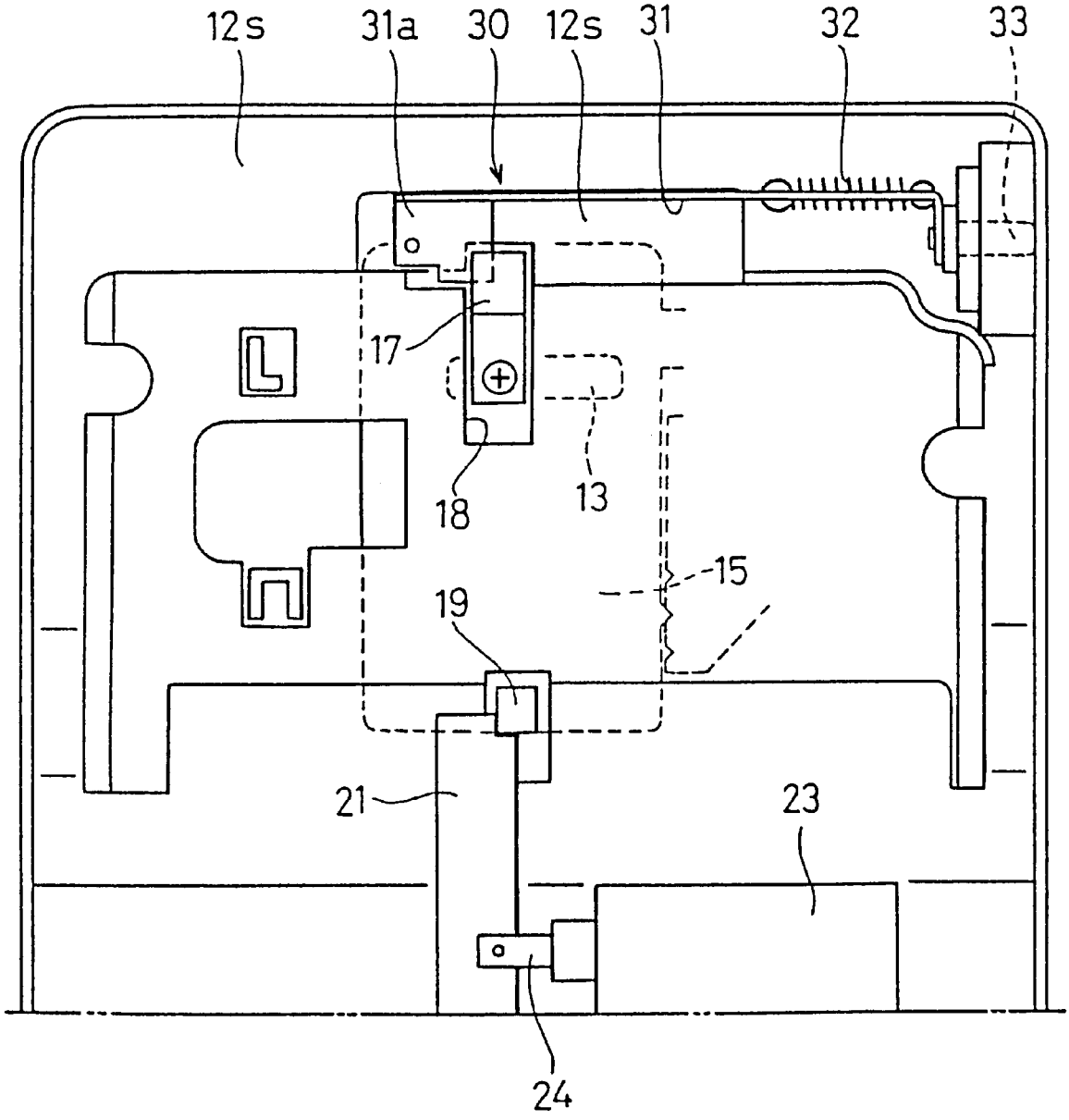
FIG. 6 is a view of the locking device showing its state after the knob plate has been moved.
Figure 7:
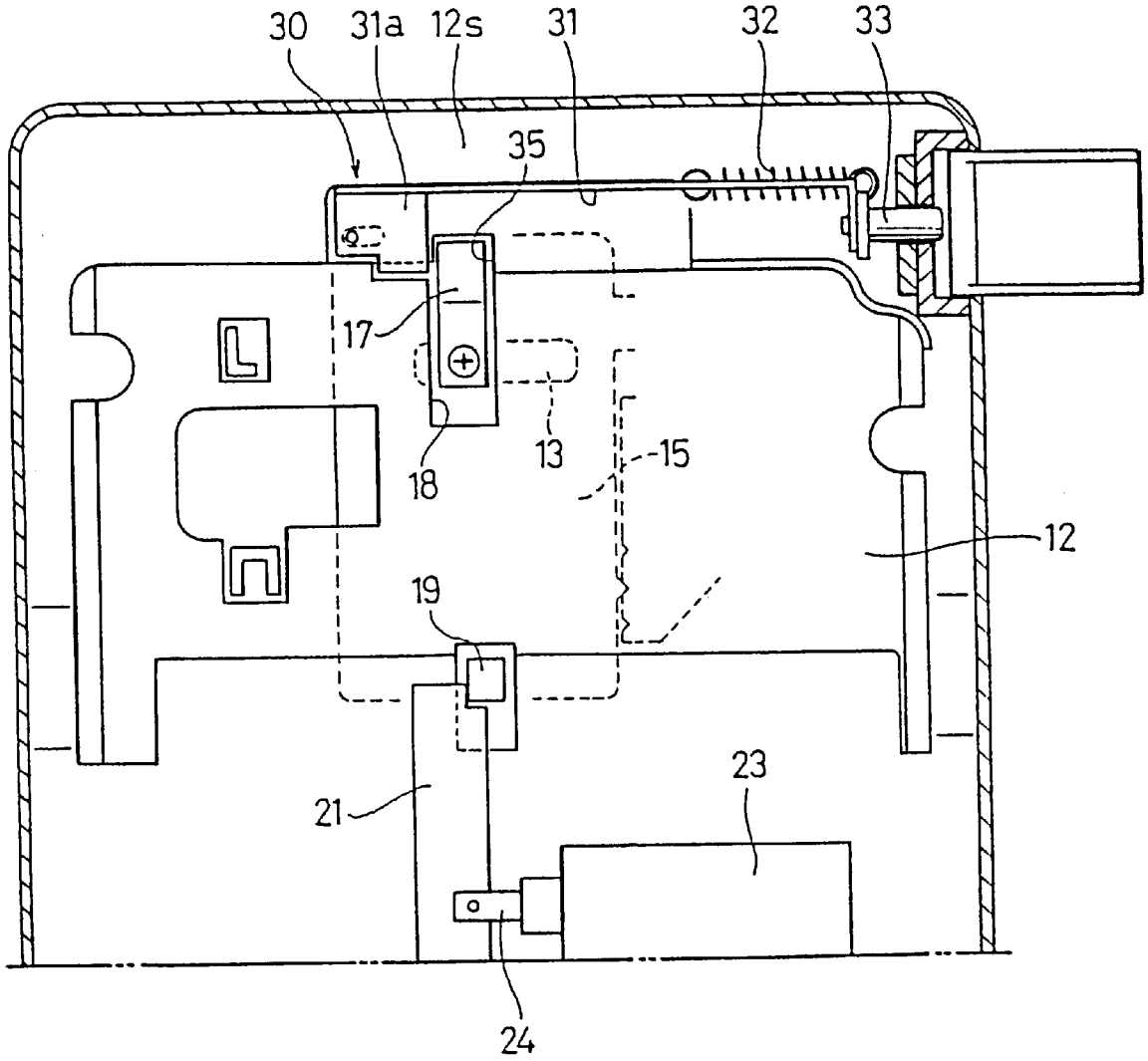
FIG. 7 is a view of the locking device showing its state when it is unlocked.

The operation of the locking device of this embodiment will now be described with reference to FIGS. 5–7, which are plan views showing the bottom of the light-shield cover 12 as viewed upwardly from inside the case.

Figure 5:
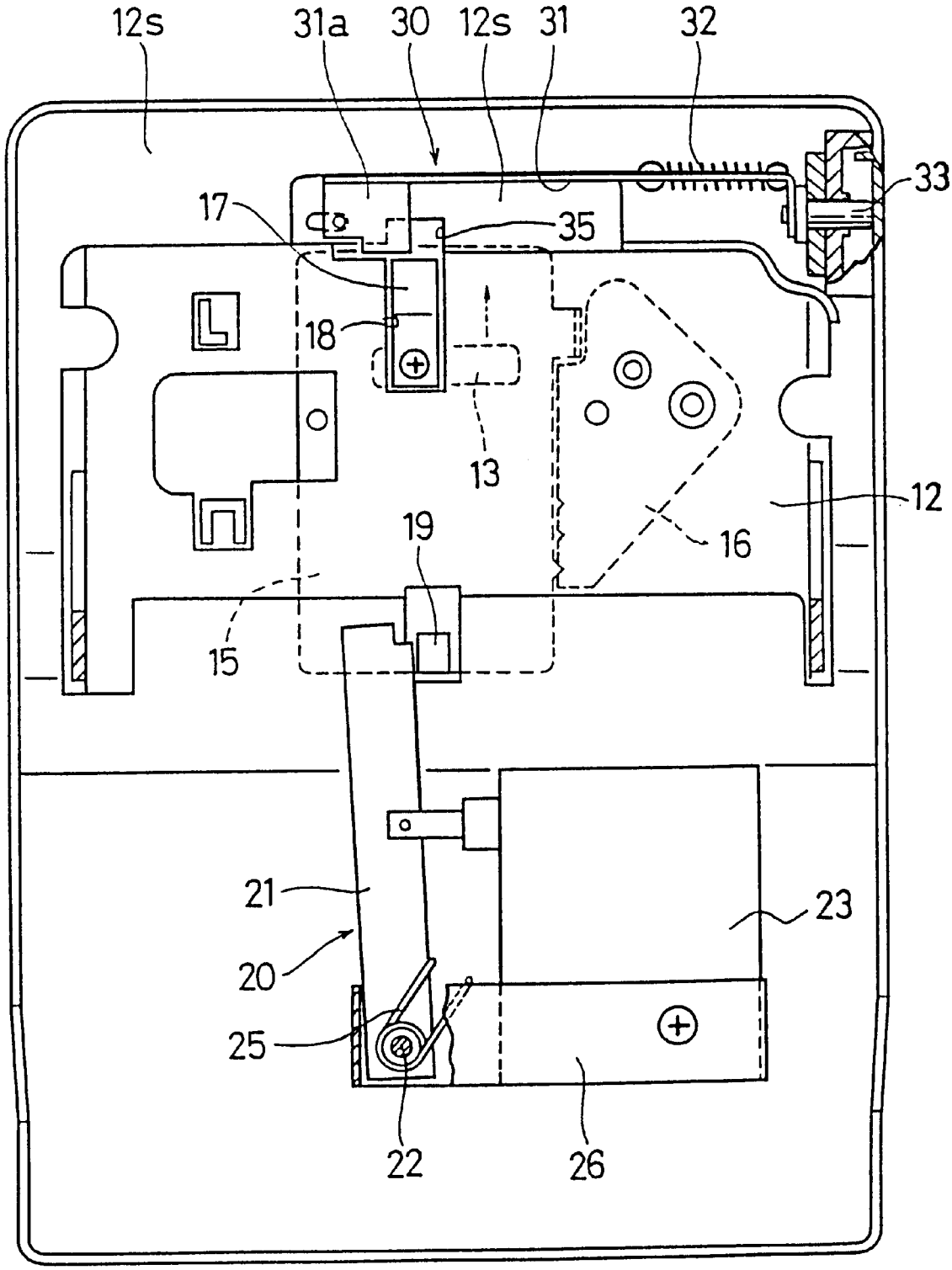
FIG. 5 is a view of the locking device showing its state before a knob plate is moved.

FIG. 5 shows the entire locking device. In the illustrated state, the light-shield cover 12 is not locked. When the knob 13 is pushed in the direction of the arrow, the knob plate 15 and the hook 17 move together until the hook is locked by engaging the tip 31*a* of the unlocking lever 31, which overlaps the side frame 12*s*.

As soon as the hook 17 is locked, an electric signal is produced to activate the solenoid 23 and pivot the locking lever 21 until it engages at its tip the protrusion 19. The knob plate 15 is now locked in position, so that the light-shield cover 12 cannot be opened. This state is shown in FIG. 6.

If the photographic processing device equipped with the locking device according to this invention should go wrong or fail immediately after it has been activated or during operation, it is necessary to open the light-shield cover to inspect the inside of the device.

But if the light-shield cover 12 is opened by moving the knob plate 15, the film may be damaged or cut because the processing machine has been stopped while the film is being processed. Thus, it is necessary to open the light-shield cover 12 without moving the knob plate 15.

Figure 4:
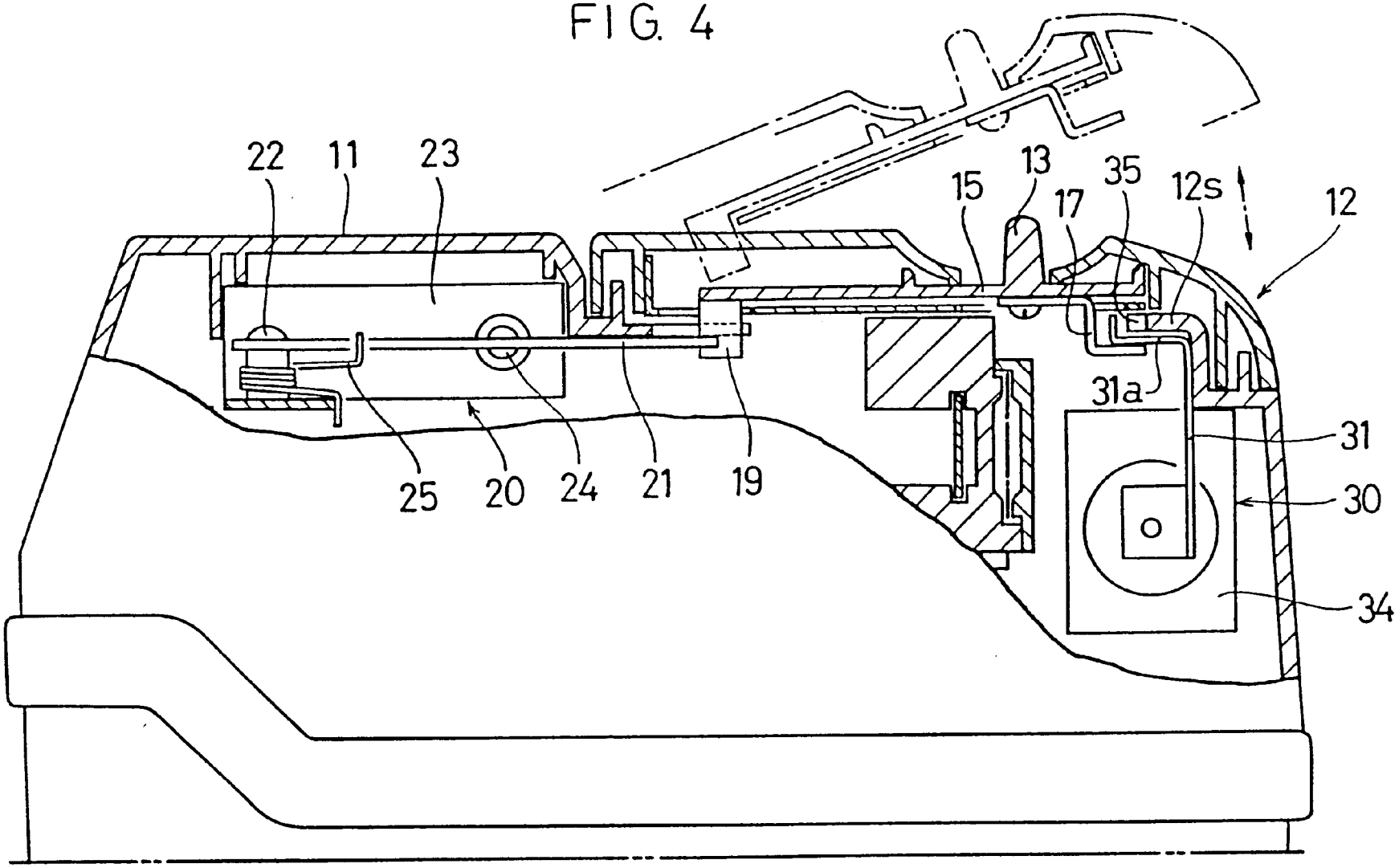
FIG. 4 is a sectional view taken along a line passing through a knob.

The unlocking mechanism 30 of this embodiment is used for this purpose. This is, by opening a lid provided outside the pushing head 33 and pushing the pushing head, the unlocking lever 31 can be moved until its tip 31*a* completely clear the recess 35 formed in the side frame 12*s*. The hook 17 can now pass through the recess 35. Thus, it is possible to pivot the light-shield cover 12 to the open position shown by chain line in FIG. 4, while keeping the solenoid 23 maintained in the locking position.

Figure 8:
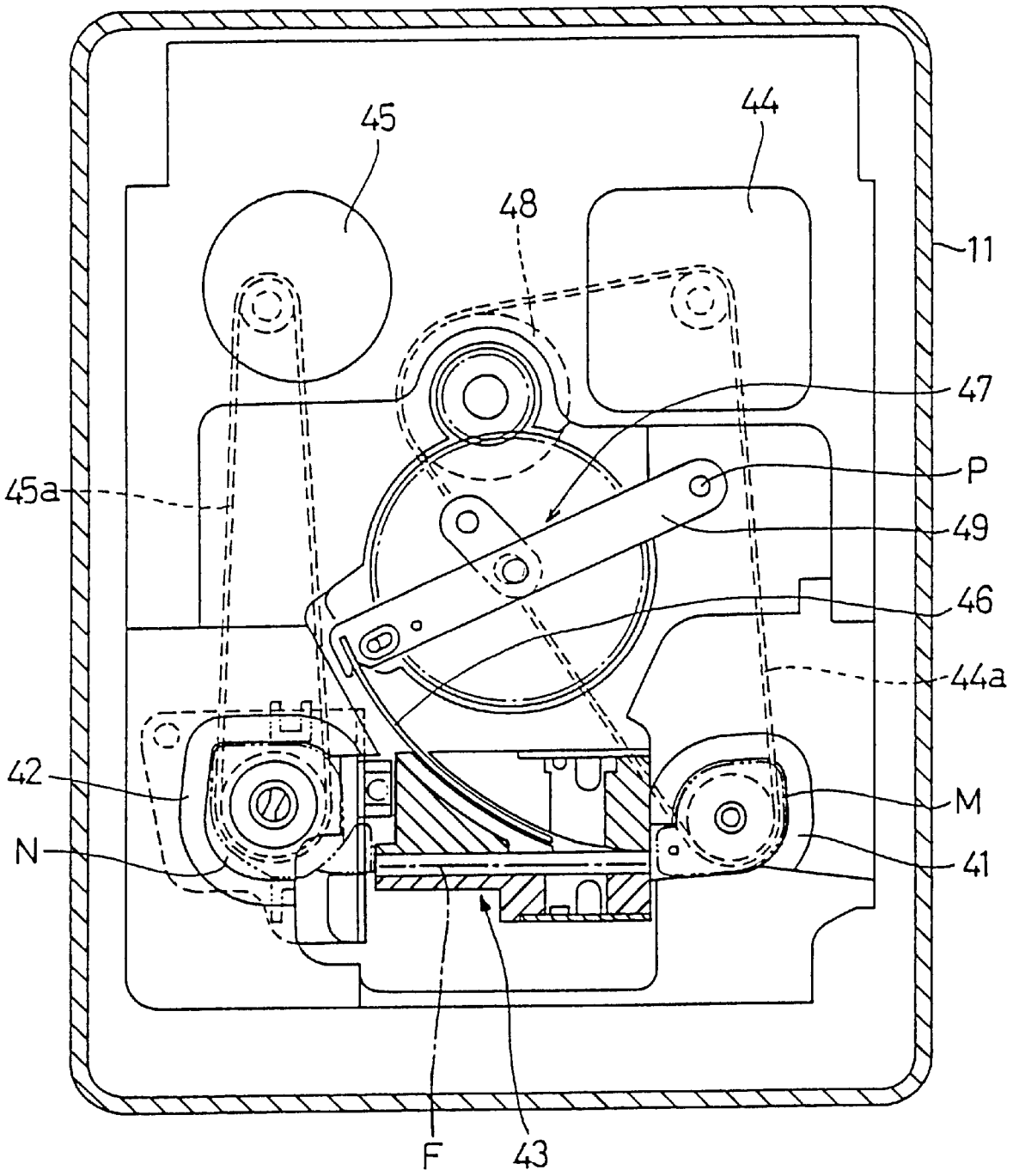
FIG. 8 is a schematic plan view of the mechanical parts of a film winder.
Figure 9:
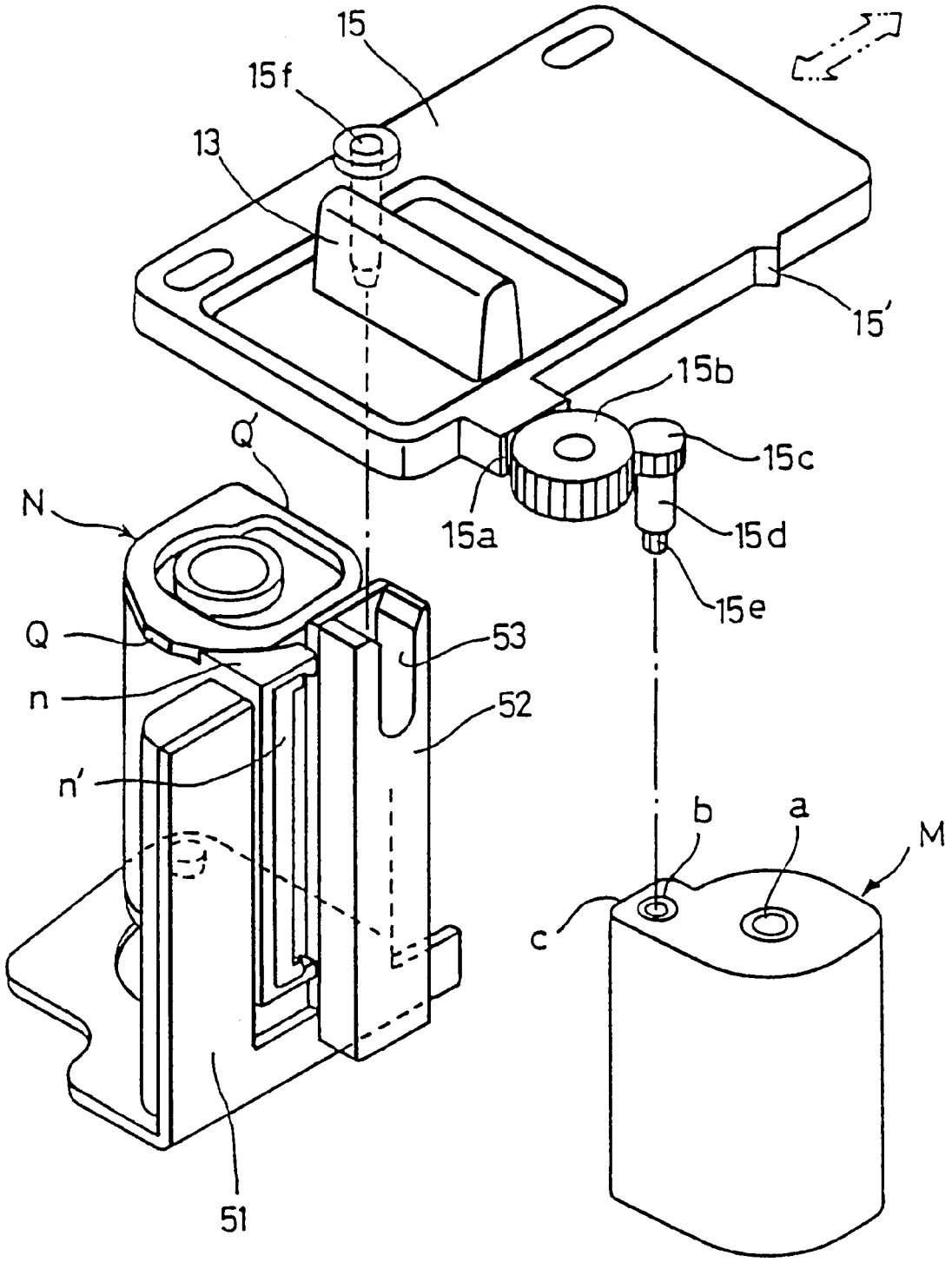
FIG. 9 is a view showing a mechanism operatively associated with the knob plate.
Figure 10:
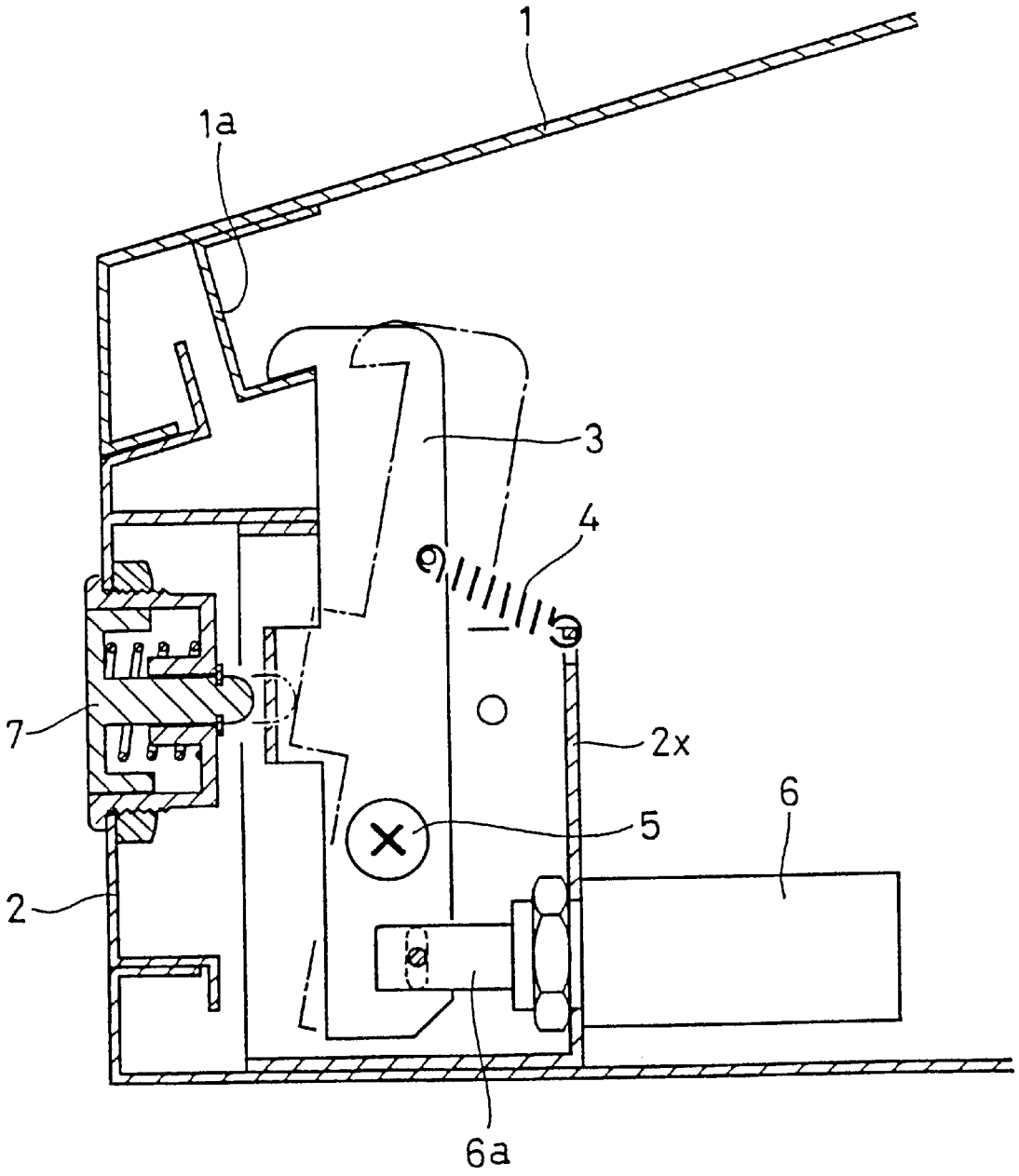
FIG.10 PRIOR ART
FIG. 10 is a schematic view of a conventional locking device.

FIGS. 8 and 9 show a film rewinder as an example of a photographic processing device equipped with the locking device according to the invention, and a mechanism that operates in cooperation with the knob plate 15. The illustrated film winder is used to rewind film from a film cartridge M to an intermediate cartridge.

The film cartridge M shown is not an ordinary patrone but a new type of cartridge developed to feed film automatically. This type of cartridge is disclosed e.g. in U.S. Pat. Nos. 5,347,334 and 5,031,852.

A film is stored in the film cartridge M with its leading end retracted in the cartridge. By rotating a spool with the film outlet door open, a leading end of the film comes out of the door. The cartridge M can thus store either an undeveloped or a developed film.

Since the film is wound with its trailing end in engagement with a hook of the cartridge spool, the film has to be manually disengaged from the hook to feed the film completely out of the cartridge. It is thus impossible to automatically feed an undeveloped or developed film for development or printing. To automate the developing and printing process, films in cartridges M have to be cut off at their trailing ends from the spools and rewound to intermediate cartridges having the same shape.

The film rewinder is used for this purpose. As shown in FIG. 8, it has a case 11 in which are provided a cartridge receptacle 41 for receiving a film cartridge M, a film winding unit 42 spaced a predetermined distance from and opposite to the cartridge receptacle 41 for rewinding film to an intermediate cartridge N, and a film guide 43 provided between the cartridge receptacle 41 and the film winding unit 42. The film rewinder is used to rewind film in the film cartridge M to the intermediate cartridge N.

The film cartridge M and the intermediate cartridge N have spools coupled to rotary shafts driven by separate motors 44 and 45 through belts 44*a* and 45*a*, respectively. When the film is fed nearly completely out of the film cartridge M and an end mark provided near the trailing end of the film is detected, the motor 44 for the film cartridge M is reversed.

A rotary shaft coupled to the film cartridge spool has a one-way clutch (not shown) so that the spool is not rotated by the motor 44 while it is rotating in the reverse direction. Rather, the reverse rotation of the motor 44 is transmitted to an arcuate tool 46 to pivot it and disengage the film trailing end from the spool of the film cartridge M.

The tool 46 is detachably coupled to one end of a pivot lever 49 pivotable about point P. The reverse rotation of the motor 44 is transmitted through the belt 44*a* and a gear train 48 to a pivot lever 49 to pivot it about point P. The tool 46 is thus inserted into the film cartridge M through its door until the film trailing end is separated from the spool by the tip of the tool 46.

FIG. 9 shows a mechanism for opening and closing the doors of the film cartridge M and the intermediate cartridge N set in the film winder in association with the movement of the knob plate 15.

As shown, this mechanism comprises a small rack 15*a* provided on one side of the knob plate 15, a pinion 15*b* in mesh with the rack 15*a*, a shaft 15*d* having at its top a small gear 15*c* in mesh with the pinion 15*b* and at its bottom a spline 15*e* adapted to engage the door opening/closing shaft b. The cartridge M has a spool shaft a and a door c.

When the knob plate 15 is moved in one direction, the door opening/closing shaft b is rotated in one direction through the above-described gear train, so that the door c is opened. By rotating the spool shaft a in this state, the film is fed out toward the intermediate cartridge N.

The intermediate cartridge N is held in position with a door-mounting portion n disposed between two pillars 51 and 52, and shoulder portions Q and Q', shown in FIG. 9, supported by support pieces 54 and 55 protruding from the back of the light-shield cover 12, as shown in FIG. 1. When the light-shield cover 12 is closed, a pin 15*f* is inserted in a recess in the pillar 52. By moving the knob plate 15 in this state, it pushes the door-mounting portion n through the pin 15*f* and the pillar 52, so that the door n' is opened.

As described above, the doors of the cartridges M and N are opened and closed by moving the knob plate 15. But according to the present invention, the movement of the knob plate is prevented by the interlocking mechanism if the film winder should stop while rewinding film from the film cartridge M to the intermediate cartridge. Thus, it is possible to prevent the film from being damaged or cut off by closing the cartridge doors.

As described above, it is possible to open the light-shield cover 12 safely by pushing the pushing head 33 of the unlocking mechanism 30. But if the film to be processed is an undeveloped film, it would become useless by being exposed to light if the light-shield cover is opened. Thus, care must be taken not to unlock the mechanism 30 if the film to be processed is an undeveloped one.

In the above embodiment, the locking device is used in a film winder. But it may be used in any other processing device having a light-shield cover that has to be locked while in operation.

As described above, the locking device according to this invention has a knob support member mounted to the light-shield cover of the processing device and operatively associated with functional members of the processing device. The light-shield cover can be locked in position by an engaging member provided on the knob plate. The interlocking mechanism prevents the movement of the knob plate with the light-shield plate locked in position by the engaging member. In an emergency case, it is possible to unlock and open the light-shield cover to inspect the inside of the device without moving the knob plate and thus without the possibility of damaging or cutting photosensitive material in the processing device.

What is claimed is:

1. A locking device for use in locking a cover in a closed position relative to a device, said locking device comprising:

a knob to be mounted on the cover for movement relative thereto between first and second positions;

a first lock including a first engaging member connected to said knob and a second engaging member to be coupled to the device, said second engaging member being movable between a locking position engaging said first engaging member when said knob is in said first position, thereby locking the cover in the closed position, and an unlocking position out of engagement with said first engaging member;

a second lock operably positioned to lock said knob in said first position and to prevent movement of said knob toward said second position, thereby maintaining engagement of said first and second engaging members when said second engaging member is in said locking position; and an unlocking mechanism operably positioned to move said second engaging member to said unlocking position and thereby to disengage said second engaging member from said first engaging member, thereby enabling the cover to be moved to the open position when said knob is locked in said first position by said second lock.

2. A locking device as claimed in claim 1, wherein the device is to be a case of a processing device for processing photographic material, the cover is to be a light shield cover, and the case is adapted to accommodate therein a film cartridge having a door that is openable and closeable to enable film to pass therethrough, and further comprising coupling means operably connected to said knob for opening and closing the door when said knob is moved to said first and second positions, respectively.

3. A locking device as claimed in claim 1, wherein said second lock comprises a locking lever to be mounted on the device and pivotable relative thereto.

4. A locking device as claimed in claim 3, wherein said locking lever is pivotable to a position in abutment with a protrusion extending from said knob.

5. A locking device as claimed in claim 1, wherein said knob extends from a knob plate that is to be mounted for sliding movement relative to the cover.

6. A locking device as claimed in claim 1, wherein said unlocking mechanism comprises an unlocking lever to be mounted on the device, and said second engaging member is integral with said lever.

7. A locking device as claimed in claim 6, further comprising a spring biassing said lever in a direction to move said second engaging member to said locking position, and a member to be mounted on the device for movement to move said lever in an opposite direction in opposition to said spring.

8. An assembly of a device to be closed, a cover mounted on said device for movement relative thereto between open and closed positions, and a locking device comprising:

a knob mounted on said cover for movement relative thereto between first and second positions;

a first lock including a first engaging member connected to said knob and a second engaging member coupled to said device, said second engaging member being movable between a locking position engaging said first engaging member when said knob is in said first position, thereby locking said cover in said closed position, and an unlocking position out of engagement with said first engaging member;

a second lock operably positioned to lock said knob in said first position and to prevent movement of said knob toward said second position, thereby maintaining engagement of said first and second engaging members when said second engaging member is in said locking position; and an unlocking mechanism operably positioned to move said second engaging member to said unlocking position and thereby to disengage said second engaging member from said first engaging member, thereby enabling said cover to be moved to said open position when said knob is locked in said first position by said second lock.

9. An assembly as claimed in claim 8, wherein said device is a case of a processing device for processing photographic material, and said cover comprises a light shield cover.

10. An assembly as claimed in claim 9, wherein said case is adapted to accommodate therein a film cartridge having a door that is openable and closeable to enable film to pass therethrough, and further comprising coupling means operably connected to said knob for opening and closing the door when said knob is moved to said first and second positions, respectively.

11. An assembly as claimed in claim 8, wherein said second lock comprises a locking lever mounted on said device and pivotable relative thereto.

12. An assembly as claimed in claim 11, wherein said locking lever is pivotable to a position in abutment with a protrusion extending from said knob.

13. An assembly as claimed in claim 8, wherein said knob extends from a knob plate that is mounted for sliding movement relative to said cover.

14. An assembly as claimed in claim 8, wherein said unlocking mechanism comprises an unlocking lever mounted on said device, and said second engaging member is integral with said lever.

15. An assembly as claimed in claim 14, further comprising a spring biassing said lever in a direction to move said second engaging member to said locking position, and a member mounted on said device for movement to move said lever in an opposite direction in opposition to said spring.

* * * * *